US009150036B2

(12) United States Patent
Naruse

(10) Patent No.: US 9,150,036 B2
(45) Date of Patent: Oct. 6, 2015

(54) CONTROL METHOD FOR PRINTING AND PRINTING APPARATUS

(71) Applicant: CANON KABUSHIKI KAISHA, Tokyo (JP)

(72) Inventor: Taketomo Naruse, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/955,045

(22) Filed: Jul. 31, 2013

(65) Prior Publication Data

US 2014/0035988 A1 Feb. 6, 2014

(30) Foreign Application Priority Data

Jul. 31, 2012 (JP) ..... 2012-169456

(51) Int. Cl.

| | |
|---|---|
| ***B41J 2/01*** | (2006.01) |
| ***B41J 29/393*** | (2006.01) |
| ***B41J 11/66*** | (2006.01) |
| ***B41J 11/00*** | (2006.01) |
| ***B41J 15/04*** | (2006.01) |

(52) U.S. Cl.

CPC ..... *B41J 11/663* (2013.01); *B41J 11/008* (2013.01); *B41J 15/04* (2013.01)

(58) Field of Classification Search

CPC ..... B41J 3/60

See application file for complete search history.

(56) References Cited

U.S. PATENT DOCUMENTS

| | | | | |
|---|---|---|---|---|
| 4,268,943 | A | 5/1981 | Watanabe et al. | |
| 4,317,270 | A | 3/1982 | Watanabe et al. | |
| 5,532,799 | A | 7/1996 | Watanabe et al. | |
| 5,915,146 | A | 6/1999 | Kusaka et al. | |
| 6,179,287 | B1 | 1/2001 | Watanabe et al. | |
| 6,240,263 | B1 | 5/2001 | Watanabe et al. | |
| 6,575,546 | B2 | 6/2003 | Matsumoto et al. | |
| 7,050,751 | B2 | 5/2006 | Watanabe et al. | |
| 2008/0159800 | A1 * | 7/2008 | Wada | 400/621 |
| 2011/0279508 | A1 | 11/2011 | Naito | |
| 2011/0310151 | A1 * | 12/2011 | Serizawa | 347/14 |
| 2013/0088541 | A1 | 4/2013 | Naito | |

FOREIGN PATENT DOCUMENTS

| | | |
|---|---|---|
| JP | H03-197140 | 8/1991 |
| JP | 2002-046260 | 2/2002 |
| JP | 2003-237157 | 8/2003 |
| JP | 4278885 | 6/2009 |
| JP | 2011-240492 | 12/2011 |
| JP | 2011-240493 | 12/2011 |

* cited by examiner

*Primary Examiner* — Shelby Fidler

(74) *Attorney, Agent, or Firm* — Fitzpatrick, Cella, Harper & Scinto

(57) ABSTRACT

A control method for carrying out printing of images on a continuous sheet, comprising: setting an area which includes a unique portion unsuitable for image printing that exists on the continuous sheet; and causing a cutter unit cut the area into a plurality of sheet pieces in a case where a length of the area which is continuous due to continuous existence of the unique portions exceeds a predetermined length.

18 Claims, 9 Drawing Sheets

701

CONSTANT LENGTH L =
FEEDING SPEED V × NON-DISCHARGEABLE TIME T

FIG.7

CONTROL METHOD FOR PRINTING AND PRINTING APPARATUS

BACKGROUND OF THE INVENTION

1. Field of the Invention

The present invention relates to a control method for printing and a printing apparatus for carrying out printing by using a rolled continuous sheet.

2. Description of the Related Art

For carrying out a great deal of printing in a laboratory print or the like, a rolled continuous sheet is used. In the case where the rolled continuous sheet is manufactured, there is a case where an area, for example, a soil area or a sheet joint area (splice portion) is generated in the sheet. In relation to an area which is partly different in a characteristic of the sheet as a print medium, for example, the soil area or the splice portion (hereinafter, refer also to as a unique portion), an identification mark is printed to a print face on the sheet.

A printing apparatus, disclosed in Japanese Patent Laid-Open No. 2011-240492, controls so as to detect a unique portion (splice portion), set the detected splice portion and a predetermined area therearound to an image print inhibiting area, and print images in other areas except that area.

In the continuous sheet, the splice portion unlikely appears continuously, however, the sheet soil area likely appears continuously. However, in the printing apparatus disclosed in Japanese Patent Laid-Open No. 2011-240492, a case where the unique portion continuously appears is not taken into consideration.

In the case where the unique portion continuously appears, the print inhibiting area does not end. Accordingly, a blank area to which the printing is not carried out continues long. As a result, a long sheet piece which is beyond assumption is discharged, so that its length disables putting it on a tray in a discharging unit or handling it in a post process, for example, a cutting machine. On the contrary, in the case where the continuous sheet is cut just after the print inhibiting area is detected, rewind and re-feed of the sheet are generated by the printing apparatus, thereby lowering efficiency of printing.

SUMMARY OF THE INVENTION

The present invention is made on the basis of recognition of the problem mentioned above. An object of the present invention is to provide a technique of enabling a control for continuously printing to be carried out without cutting the continuous sheet as long as possible in the case where the unique portion continuously appears in the continuous sheet.

A control method for carrying out printing of images on a continuous sheet according to the present invention in order to achieve the object mentioned above is a method comprising: setting an area which includes a unique portion unsuitable for image printing that exists on the continuous sheet; and causing a cutter unit cut the area into a plurality of sheet pieces in a case where a length of the area which is continuous due to continuous existence of the unique portions exceeds a predetermined length.

According to the present invention, it is possible to suppress reduction of printing efficiency in the case where the unique portion continuously appears on the sheet. Further, it is possible to discharge the sheet piece having a length that can be stored in a discharging unit of the printing apparatus. Further, it is possible to discharge the sheet piece having a length that can be easily worked in a post process.

Further features of the present invention will become apparent from the following description of exemplary embodiments (with reference to the attached drawings).

BRIEF DESCRIPTION OF THE DRAWINGS

FIG. 7 is a formula showing an example for determining a predetermined length L;

DESCRIPTION OF THE EMBODIMENTS

Embodiment of the Present Invention

A description will be given below of an embodiment of a printing apparatus using an ink jet system. The printing apparatus according to the present embodiment is a high-speed line printer which uses a long and continuous sheet and supports both of a single-sided printing and a double-sided printing. In the present specification, the long and continuous sheet means a continuous sheet in which a length in a sheet feeding direction is longer than a length of a repeated print unit. Further, in the present specification, the repeated print unit means, for example, one page or a unit image. The printing apparatus according to the present embodiment is suitable for a printing field of a larger number of sheets, for example, in a print laboratory or the like. Incidentally, in the present specification, even if there is a case where a plurality of small images, letters or spaces are mixed in an area of one printing unit (one page), those included in the area are collectively called as one unit image. In other words, the unit image means one print unit (one page) in the case where a plurality of pages are printed sequentially in the continuous sheet. Incidentally, the unit image may be simply called as an image. A length of the unit image is different according to a size of the printed image. For example, the length in the sheet feeding direction is 135 mm for a photograph of an L plate size, and the length in the sheet feeding direction is 297 mm for an A4 size. The present invention can be widely applied to a printing apparatus which employs ink and requires drying, such as a printer, a printer complex machine, a copying machine, a facsimile machine, and a manufacturing apparatus for various devices.

Figure 1:
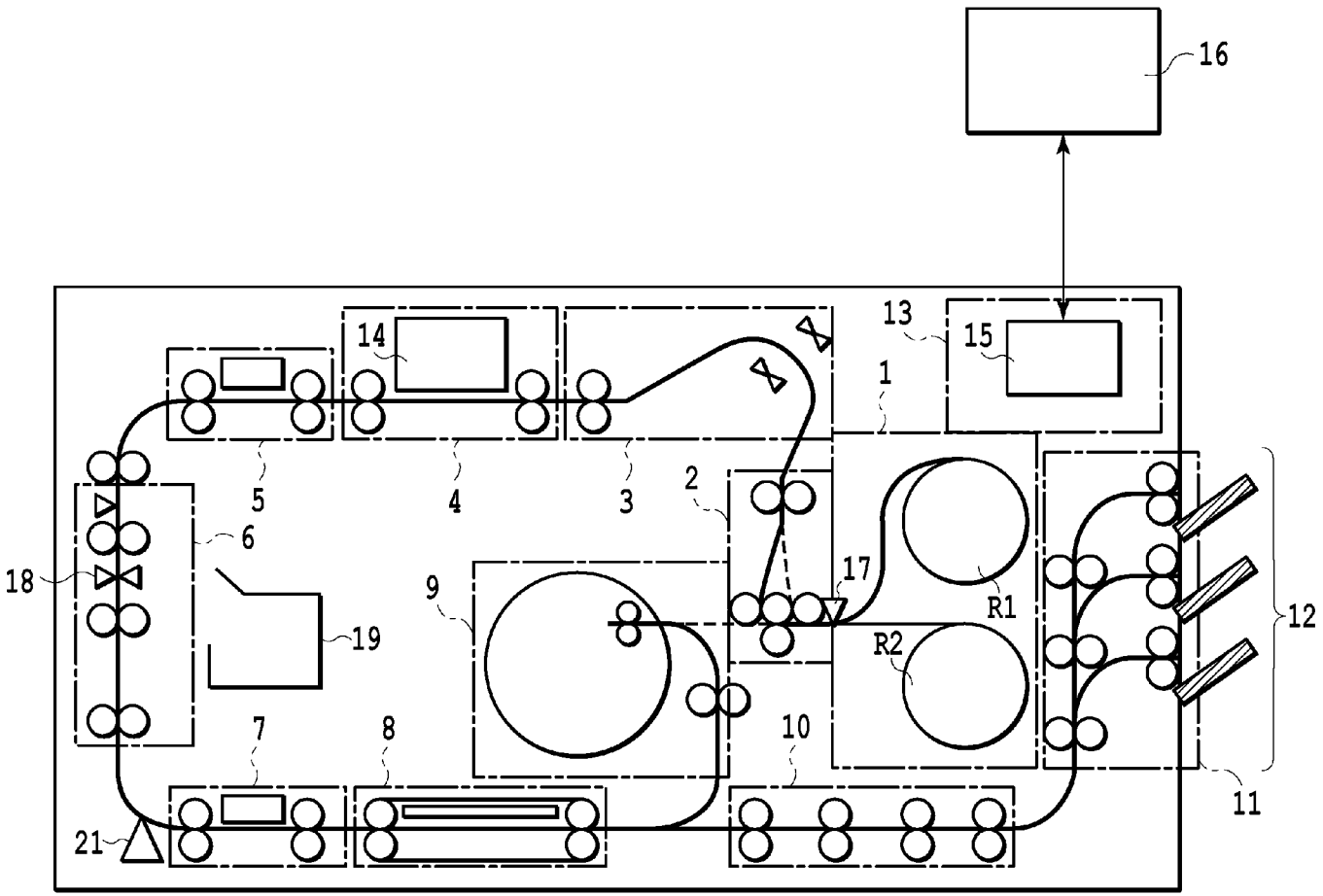
FIG. 1 is a schematic view showing an internal structure of a printing apparatus.

FIG. 1 is a schematic cross-sectional view showing an internal structure of a printing apparatus. The printing apparatus according to the present embodiment employs a rolled sheet and can apply a double-sided printing to a first face of the sheet and a second face that is a back side of the first face. An inner portion of the printing apparatus is roughly provided with respective units of a sheet supply unit 1, a decurling unit 2, an oblique correcting unit 3, a printing unit 4, an inspecting unit 5, a cutter unit 6, an information printing unit 7, a drying unit 8, a reversing unit 9, a discharge feeding unit 10, a sorter unit 11, a discharging unit 12, a control unit 13. The discharging unit 12 refers to the unit which includes the sorter unit 11 and carries out a discharging process. The sheet is fed by a feeding mechanism comprising roller pairs and belts along a sheet feed path which is shown by a solid line in the drawing, and a process is carried out in each of the units. Incidentally, at an arbitrary position of the sheet feed path, a close side to the sheet supply unit 1 is called as "upstream" and an opposite side thereto is called as "downstream".

The sheet supply unit 1 is a unit for holding and supplying the continuous sheet which is wound like a roll. The sheet supply unit 1 can accommodate two rolls of sheets R1 and R2, and is configured to alternatively pull out and supply the sheet. Incidentally, the number of the rolls which can be accommodated is not limited to two, but one roll or three or more rolls may be accommodated. Further, the sheet is not limited to the sheet wound like a roll, as long as the sheet is a continuous sheet. For example, the sheet may be a continuous sheet provided with perforated lines per unit length in which the continuous sheet is folded at every perforated line so as to be laminated, and is accommodated in the sheet supply unit 1.

The continuous sheet used here is structured such that a unique portion mark is previously printed so that it is possible to detect a unique portion, for example, a soil area. In the present specification, the unique portion means an area in which a characteristic of the sheet as a print media is partly different and unsuitable for image printing. In the present invention, the unique portion is an area which is not suitable for an image printing as a final product. The unique portion includes, for example, a sheet splice portion (which may be also called as a connection portion, a joint portion or a junction portion), a soil (aqueous or oily) area, a discolored area, a flaw area, a bent area, a broken area, a hole area, a residual matter area, a foreign material mixed area and an uneven thickness area. A unique portion mark sensor 17 (a detecting unit) is provided in the vicinity of an outlet of the sheet supply unit 1, and detects the unique portion mark of the continuous sheet which is supplied from the sheet supply unit 1.

The decurling unit 2 is a unit which lighten curl (warpage) of the sheet supplied from the sheet supply unit 1. In the decurling unit 2, a decurling force is applied by using two pinch rollers in relation to one drive roller and making the sheet pass through while bending the sheet so as to apply a warpage in a reverse direction to the curl, thereby lightening the curl.

The oblique correcting unit 3 is a unit which corrects an oblique of the sheet that passed through the decurling unit 2. In the present specification, the oblique of the sheet means an incline in relation to a normal travelling direction. The oblique of the sheet is corrected by pressing a sheet edge of a reference side to a guide member. In the oblique correcting unit 3, a loop is formed for the fed sheet.

The printing unit 4 is a sheet processing unit which forms an image on the fed sheet by applying a printing process thereto from the above with a printing head 14. In other words, the printing unit 4 is the processing unit which applies the predetermined process to the sheet. The printing unit 4 is also provided with a plurality of feed rollers which feed the sheet. The printing head 14 has a line type printing head in which an ink jet type nozzle line is formed in a range covering a maximum width of the sheet to be expected to be used. The printing head 14 is structured such that a plurality of printing heads are arranged in parallel along the feeding direction. In the present embodiment, the printing head 14 includes seven printing heads corresponding to seven colors, C (cyan), M (magenta), Y (yellow), LC (light cyan), LM (light magenta), G (gray) and K (black). Incidentally, the number of the colors and the number of the printing heads are not limited to seven. The ink jet system can employ a system using a heater element, a system using a piezoelectric element, a system using an electrostatic element, and a system using an MEMS element or the like. The ink for each of the colors is supplied to the printing head 14 from an ink tank via an ink tube.

The inspecting unit 5 is a unit for determining whether or not the image is accurately printed, by optically reading with a scanner an inspection pattern and an image which is printed on the sheet by the printing unit 4, and inspecting a nozzle state of the printing head, a sheet feed state, and an image position or the like. The scanner has a CCD image sensor or a CMOS image sensor.

The cutter unit 6 is a unit which is provided with a mechanical cutter 18 for cutting the printed sheet at a predetermined length. The cutter unit 6 is further provided with a cut mark sensor optically detecting a cut mark printed on the sheet and a plurality of feed rollers for feeding the sheet to the next process. A trash box 19 is provided in the vicinity of the cutter unit 6. The trash box 19 is structured such as to accommodate small sheet pieces which are cut off by the cutter unit 6 so as to be discharged as trash. The cutter unit 6 is provided with a sorting mechanism which discharges the cut sheet to the trash box 19 or transfers the cut sheet to the normal feed path.

The information printing unit 7 is a unit which prints the print information (inherent information), for example, serial number and date onto aback face. The printing is carried out by printing letters or codes according to an ink jet system, a thermal transfer system or the like.

The drying unit 8 is a unit for drying the applied ink for a short time by heating the sheet which is printed by the printing unit 4. In an inner portion of the drying unit 8, the ink applied face is dried by applying hot wind to the passing sheet at least from a lower face side. Incidentally, the drying system is not limited to the system which applies the hot wind, but may employ a system which irradiates electromagnetic wave (ultraviolet light, infrared light or the like) to the surface of the sheet.

The sheet feed path from the sheet supply unit 1 to the drying unit 8 is called as a first path. The first path has a shape which is U-turned between the printing unit 4 and the drying unit 8, and the cutter unit 6 is positioned in the middle of the U-turn shape.

The reversing unit 9 is a unit for temporarily winding and reversing the continuous sheet which is finished with the front face printing in the case where the double-sided print is carried out. The reversing unit 9 is provided in the track of a path (a loop path) (called as a second path) which runs into the printing unit 4 from the drying unit 8 via the decurling unit 2, for again supplying the sheet that passed through the drying unit 8 to the printing unit 4. The reversing unit 9 is provided with a winding rotary body (drum) which rotates for winding the sheet. The continuous sheet which is finished with the printing of the front face and is not cut is temporarily wound to the winding rotary body. After the winding, the winding rotary body reversely rotates, and the wound sheet is fed out in a reverse order to the case of winding so as to be supplied to the decurling unit 2, and is fed to the printing unit 4. Since the sheet is reversed, it is possible to print on a back face by the printing unit 4. On the assumption that the sheet supply unit 1 is a first sheet supply unit, the reversing unit 9 can be assumed as a second sheet supply unit.

The discharge feeding unit 10 is a unit for feeding the sheet which is cut by the cutter unit 6 and is dried by the drying unit 8 and transferring the sheet to the sorter unit 11. The discharge feeding unit 10 is provided in a path (called as a third path)

which is different from the second path provided with the reversing unit 9. In order to selectively guide the sheet which is fed along the first path to any one of the second path and the third path, a path switching mechanism having a movable flapper is provided at a branch position (called as "discharge branch position") of the path.

The discharging unit 12 including the sorter unit 11 is provided at a terminal end of the third path and at a side portion of the sheet supply unit 1. The sorter unit 11 is a unit for sorting the printed sheet per group as occasion demands. The sorted sheet is discharged to a plurality of trays which are included in the discharging unit 12. As mentioned above, the third path has a layout which passes through the below of the sheet supply unit 1 and discharges the sheet to a side opposite to the printing unit 4 and the drying unit 8 by sandwiching the sheet supply unit 1.

As mentioned above, the units from the sheet supply unit 1 to the drying unit 8 are provided in sequence in the first path. A forward side of the drying unit 8 is branched into the second path and the third path, the reversing unit 9 is provided in the track of the second path, and a forward side of the reversing unit 9 is merged with the first path. The discharging unit 12 is provided in a terminal end of the third path.

The control unit 13 is a unit which carries out control of each of the units in a whole of the printing apparatus. The control unit 13 has a CPU, a memory device, a controller provided with various control units, an external interface, and an operation unit 15 which is input and output by a user. An operation of the printing apparatus is controlled on the basis of a command from a host device 16, for example, the controller or a host computer which is connected to the controller via the external interface.

Figure 2:
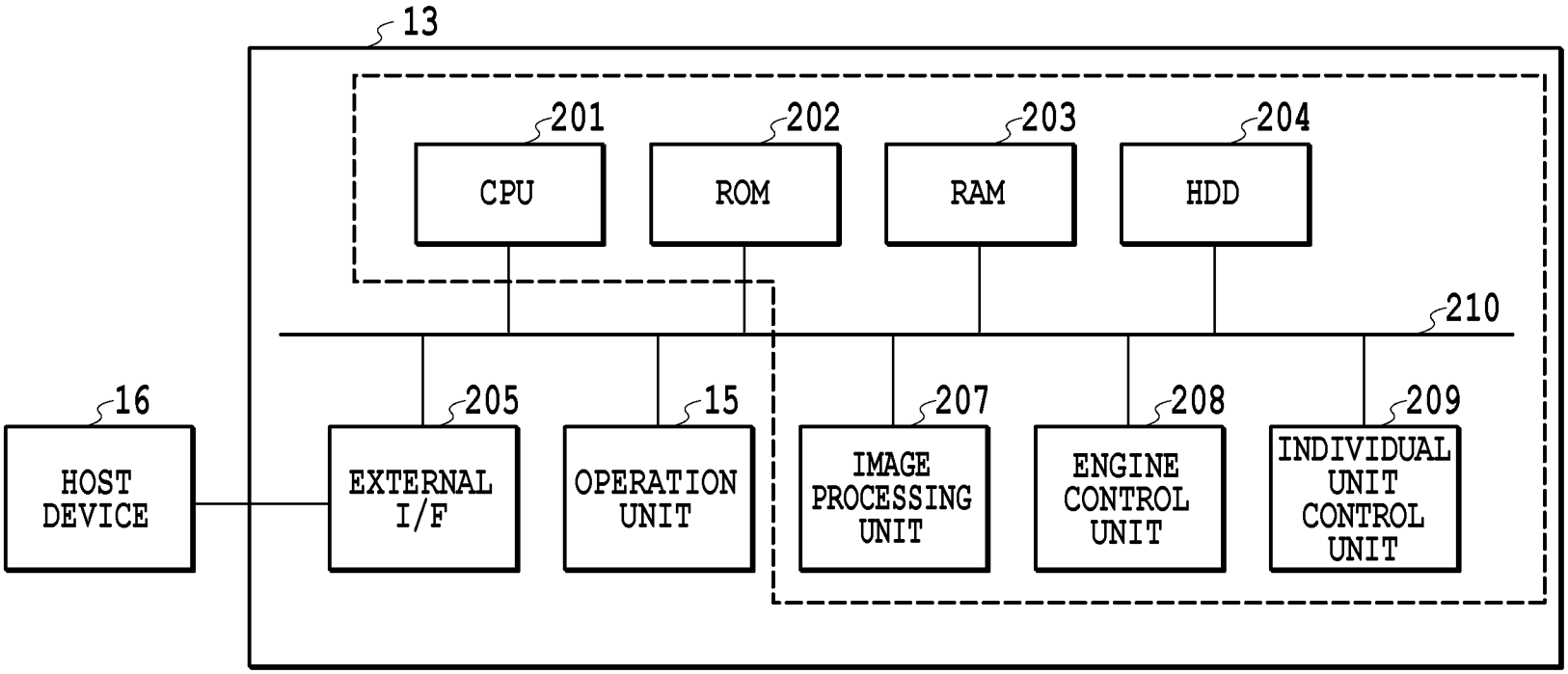
FIG. 2 is a block diagram showing an electric structure of a control unit of the printing apparatus.

FIG. 2 is a block diagram showing a concept of the control unit 13. The controller (a range surrounded by a broken line) included in the control unit 13 comprises a CPU 201, a ROM 202, a RAM 203, a HDD 204, an image processing unit 207, an engine control unit 208, and an individual unit control unit 209. The CPU (central processing unit) 201 controls an operation of each of the units of the printing apparatus in an integrative manner. The ROM 202 stores programs which the CPU 201 executes, and fixed data which is necessary for various operations of the printing apparatus. The RAM 203 is used as a work area of the CPU 201, is used as a temporary storing area for various received data, and stores various setting data. The HDD (hard disc drive) 204 can store and read out the programs which the CPU 201 executes, print data, and setting information which is necessary for the various operations of the printing apparatus. The operation unit 15 is an input and output interface for the user, and includes an input unit, for example, a hard key and a touch panel, and an output unit, for example, a display providing the information and a voice generator.

A dedicated processing unit is provided for a unit which is demanded a high-speed data processing. The image processing unit 207 carries out an image processing of the print data which is handled by the printing apparatus. A color space (for example, YCbCr) of the input image data is converted into a standard RGB color space (for example, sRGB). Further, various image processing, for example, a resolution conversion, an image analysis and an image correction is applied to the image data as occasion demands. The print data obtained by the image processing is stored in the RAM 203 or the HDD 204. The engine control unit 208 carries out drive control of the printing head 14 of the printing unit 4 corresponding to the print data on the basis of the control command received from the CPU 201 or the like. The engine control unit 208 further carries out control of the feeding mechanism for each of the units within the printing apparatus. The individual unit control unit 209 is a sub controller for individually controlling each of the units including the sheet supply unit 1, the decurling unit 2, the oblique correcting unit 3, the inspecting unit 5, the cutter unit 6, the information printing unit 7, the drying unit 8, the reversing unit 9, the discharge feeding unit 10, the sorter unit 11, and the discharging unit 12. The individual unit control unit 209 controls the operation of each of the units on the basis of the command from the CPU 201. The external interface 205 is an interface (I/F) for connecting the controller to the host device 16, and is a local I/F or a network I/F. The constituting elements mentioned above are connected via a system bus 210.

The host device 16 is a device serving as a supply source of the image data for making the printing apparatus carry out the printing. The host device 16 may be a general purpose computer or a dedicated computer, or may be dedicated image equipment, for example, an image capture having an image reader unit, a digital camera or a photo storage. In the case where the host device 16 is a computer, an operating system (OS), an application software creating image data, and a printer driver for the printing apparatus are installed in the memory device included in the computer. Incidentally, it is not essential to execute all the processes mentioned above by the software, a partial process or all the process may be executed by the hardware.

Subsequently, a basic operation in printing will be described. Since the operation is different between a single-sided print mode and a double-sided print mode in the printing, each of the operations will be described.

In the single-sided print mode, the sheet which is supplied from the sheet supply unit 1 and is processed by each of the decurling unit 2 and the oblique correcting unit 3 is printed on its front face (first face) in the printing unit 4. A plurality of images are formed side by side in the long continuous sheet, by sequentially printing images (unit images) each having a predetermined unit length in the feeding direction. The printed sheet is passed through the inspecting unit 5 and is cut per unit image by the cutter unit 6. The cut sheet after being cut is printed with the print information on a back face of the sheet by the information printing unit 7 as occasion demands. Further, the cut sheets are fed one by one to the drying unit 8 so as to be dried. Thereafter, the cut sheets are sequentially discharged to the tray of the discharging unit 12 via the discharge feeding unit 10 so as to be stacked. On the other hand, the sheet which is left in a side of the printing unit 4 by cutting the final unit image is turned back to the sheet supply unit 1, and the sheet is wound up on the roll R1 or R2. As mentioned above, in the single-sided printing, the sheet is processed while passing through the first path and the third path; and the sheet does not pass through the second path.

On the other hand, in the double-sided print mode, a back face (second face) print sequence is executed next to a front face (first face) print sequence. In the first front face print sequence, an operation in each of the units from the sheet supply unit 1 to the inspecting unit 5 is the same as the operation of the single-sided printing mentioned above. A cutting operation is not carried out in the cutter unit 6, and the sheet is maintained in its continuous form while being fed to the drying unit 8. After drying the ink on the front face by the drying unit 8, the sheet is guided to the path (the second path) in a side of the reversing unit 9 in place of the path (the third path) in a side of the discharge feeding unit 10. The sheet is wound up on the winding rotary body of the reversing unit 9 which turns in a forward direction (a counterclockwise direction in the drawing) in the second path. In the case where all the planned printing of the front face is finished in the printing unit 4, a rear end of the printed area of the continuous sheet is cut by the cutter unit 6. With reference to the cut position, the continuous sheet in a downstream side (a printed side) in the feeding direction is wound up until the rear end (the cut position) of the sheet by the reversing unit 9 via the drying unit 8. On the other hand, in parallel with winding in the reversing unit 9, the continuous sheet which is left in an upstream side (a side of the printing unit 4) in the feeding direction from the cut position is fed back to the sheet supply unit 1 so that a leading end (the cut position) of the sheet does not stay in the decurling unit 2, and the sheet is wound up on the roll R1 or R2. By this turning back (back feed), collision with the sheet which is again supplied according to the following back face print sequence can be avoided.

After the front face print sequence mentioned above, the sequence is switched to the back face print sequence. The winding rotary body of the reversing unit 9 turns in a reverse direction (a clockwise direction in the drawing) to the direction in the case of winding up. An end portion of the wound sheet (the sheet rear end in the case of winding up is the sheet leading end in the case of feeding) is fed into the decurling unit 2 along a path shown by a broken line in the drawing. In the decurling unit 2, the curl applied by the winding rotary body is corrected. In other words, the decurling unit 2 is provided between the sheet supply unit 1 and the printing unit 4 in the first path, and between the reversing unit 9 and the printing unit 4 in the second path, and is a common unit which serves to decurl in any of the paths. The sheet whose front and back faces are reversed is fed to the printing unit 4 via the oblique correcting unit 3, and the printing is applied to the back face of the sheet. The printed sheet is passed through the inspecting unit 5 and is cut per a predetermined unit length which is previously set in the cutter unit 6. Since the cut sheet is printed its both faces, the cut sheet is not recorded by the information printing unit 7. The cut sheets are fed one by one to the drying unit 8, and are sequentially discharged to the tray of the discharging unit 12 via the discharge feeding unit 10 so as to be stacked. As mentioned above, in the double-sided printing, the sheet is processed by sequentially passing through the first path, the second path, the first path and the third path.

Figure 3:
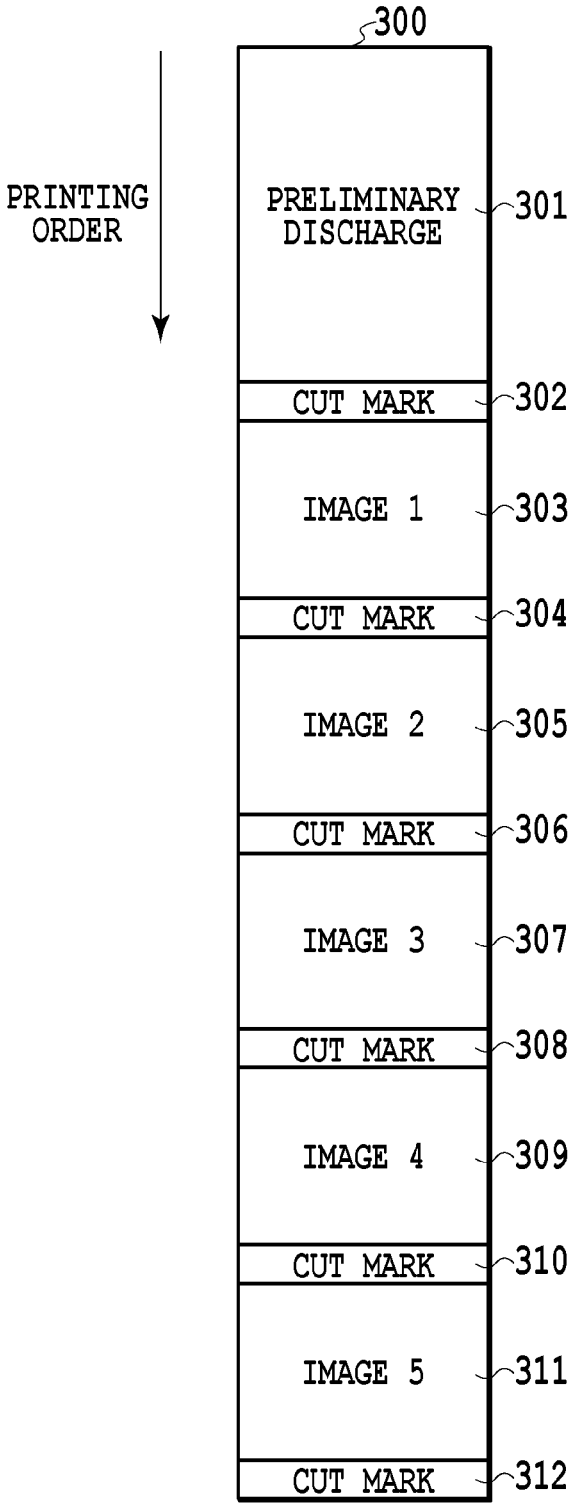
FIG. 3 is a view showing an example of a print pattern in a case of normal printing.

FIG. 3 shows a normal print pattern which is used in the present embodiment. A printing order of the unit images and maintenance patterns applied to the continuous sheet 300 is shown. In the present specification, the maintenance pattern generically names the other print patterns than the unit image, for example, a pattern for the purpose of maintaining performance of the equipment such as a preliminary discharge pattern and a non-discharge monitoring pattern, and a cut mark which is a reference for the sheet cutting. The preliminary discharge pattern is a pattern which is formed by discharging the ink from all the nozzles for periodical head maintenance, in order to prevent the nozzle having a low frequency in use from being defective in the ink discharge. An image 1 to an image 5 are printed as the unit images, and the preliminary discharge pattern and the cut marks are printed as the maintenance pattern, in the print pattern in FIG. 3. The preliminary discharge pattern 301 is printed at the forefront of the printing for recovering the ink jet head. Thereafter, the printing of the cut mark and the printing of the unit image are repeated.

Figure 4:
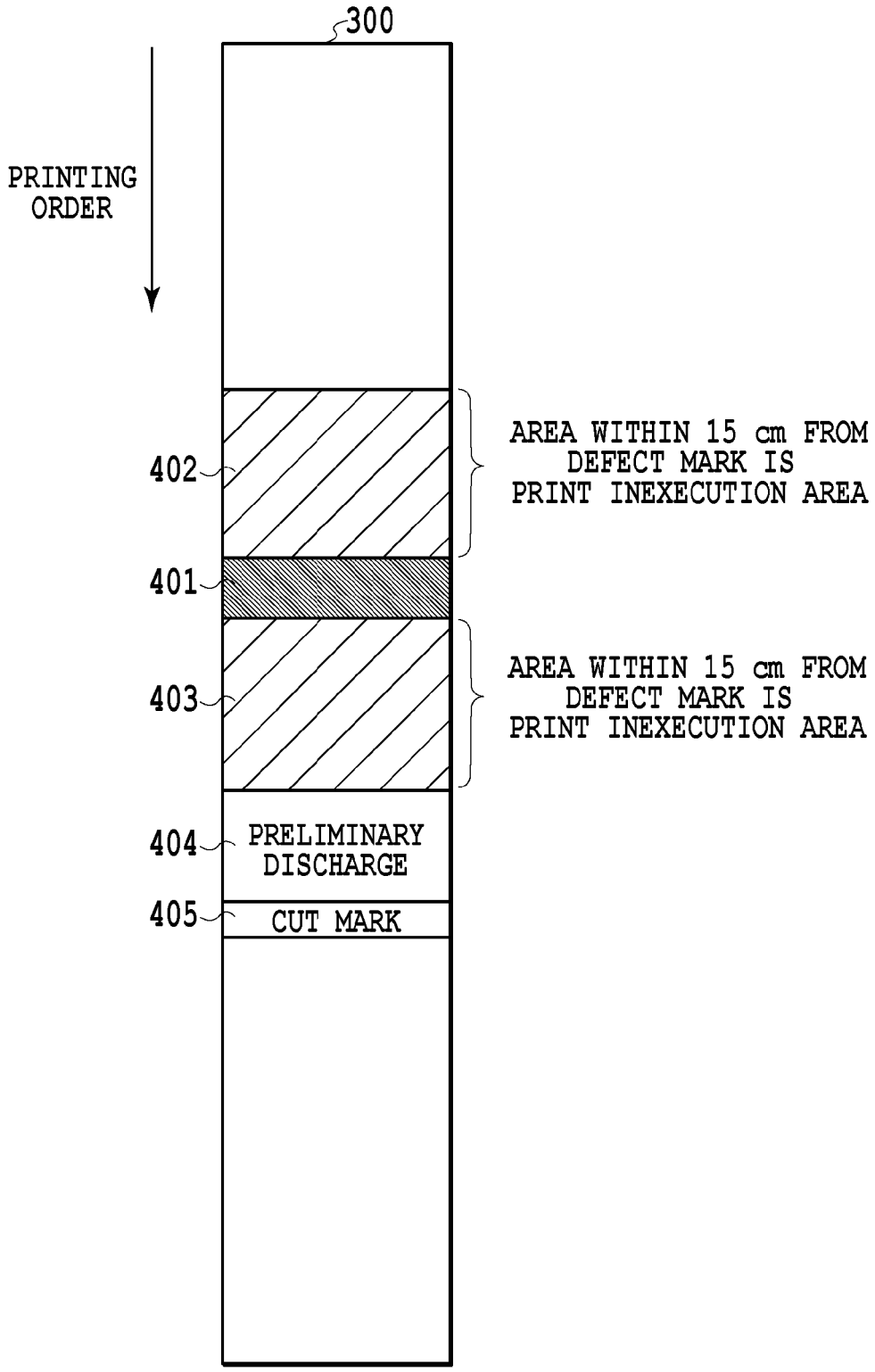
FIG. 4 is a view showing a process in detecting a unique portion mark.

FIG. 4 shows a specification in the case where a unique portion mark exists in the continuous sheet 300. In the case where the unique portion is generated in the sheet due to some cause in the manufacturing process of the sheet, a unique portion mark 401 for specifying and detecting the portion is applied. Some cause has a residual matter, a foreign material mixing, an oil drop from the apparatus and an uneven distribution of dye or the like. Further, in the case where the sheets are bonded to each other by a splice sheet for manufacturing the long continuous sheet, the unique portion is generated. Further, in the case where an uneven tension is applied to the continuous sheet in working, for example, the cutting work or the winding work, and the case where the continuous sheet comes into contact with the other material, the unique portion, for example, a flaw, a bending or a breaking of the sheet may be generated.

An area around the portion to which the unique portion mark 401 is applied is set to a printing inexecution area (a printing inhibition area) to which printing is not applied. In the present embodiment, it is assumed that the unique portion exists at a position which is within 15 cm back and forth from the unique portion mark 401 for some reasons of the manufacturing process. In this case, areas which are 15 cm back and forth in the printing direction of the unique portion mark 401 are set to printing inexecution areas 402 and 403. However, this is only one example, and does not intend to limit the present invention to the specific mode. The unique portion mark can be variously embodied.

The unique portion mark 401 is detected by the unique portion mark sensor 17 which is included in the detecting unit. In the case where the unique portion mark 401 is detected, the continuous sheet is fed without applying the printing to the printing inexecution area 402, the area of the unique portion mark 401 and the printing inexecution area 403, and the preliminary discharge pattern 404 is printed to the following area. Subsequently, the cut mark 405 is printed, and the operation is returned to the normal printing, that is, the printing in the case where the unique portion mark is not detected.

Figure 5:
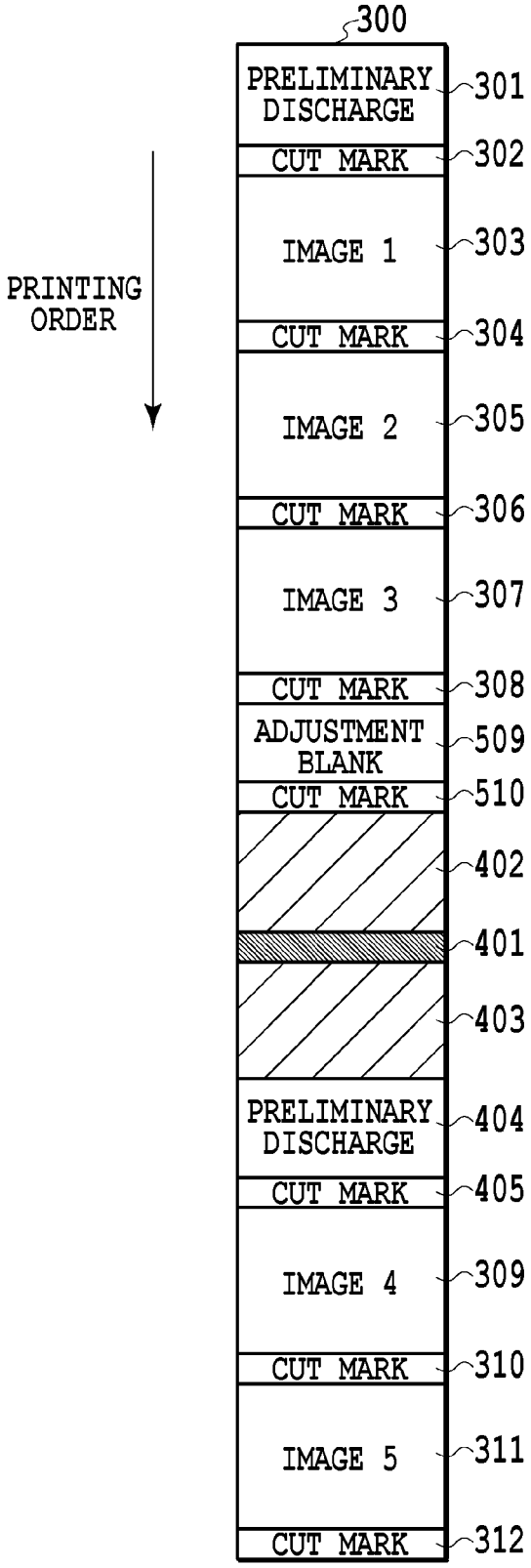
FIG. 5 is a view showing an example of a print pattern in detecting the unique portion mark.
Figure 6:
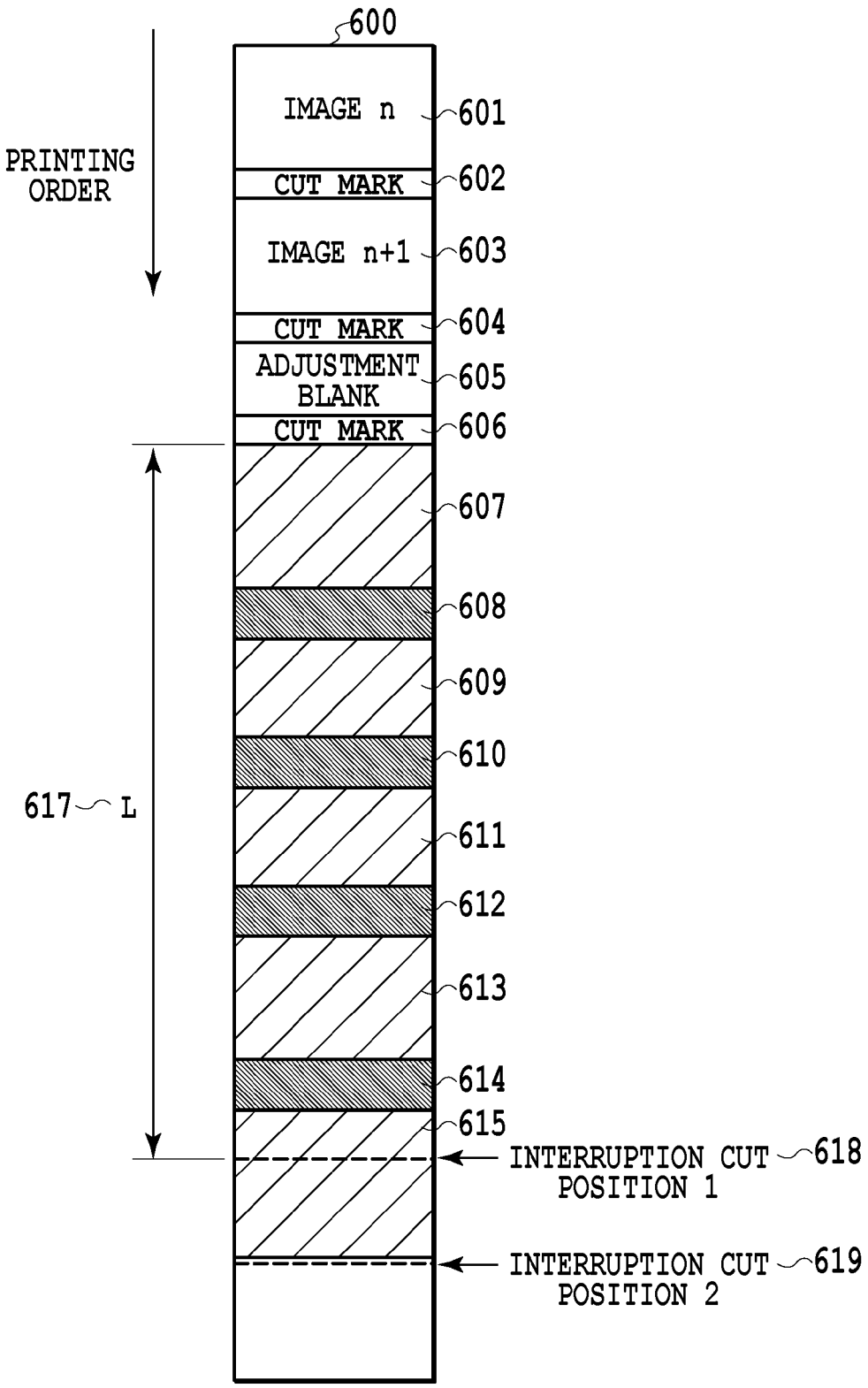
FIG. 6 is a view describing a process in the case where the unique portion mark is continuously detected.

FIGS. 5 and 6 respectively show a print pattern in the case where the unique portion mark is sporadically detected, and a print pattern in the case where the unique portion mark is continuously detected.

First of all, a description will be given of the case where the unique portion mark is sporadically detected, with reference to FIG. 5. In the print pattern in FIG. 5, the print pattern from the preliminary discharge pattern 301 to the cut mark 308 is the same as the normal printing pattern shown in FIG. 3. In the case where the unique portion mark 401 is detected, the printing inexecution areas 402 and 403 are set at the positions which are 15 cm back and forth from the unique portion mark 401 as mentioned above. A length which can be used after the image 3 can be calculated on the basis of a relative position between the image 3 and the printing inexecution area 402. In the present embodiment, the usable length is less than the length for printing an image 4 (309) before the unique portion mark 401. Accordingly, the image 4 (309) is not printed here, instead an adjustment blank 509 is inserted to an area between a rear end portion of the cut mark 308 and a leading end portion of the printing inexecution area 402, and a cut mark 510 is printed. Subsequently, the continuous sheet is fed without applying the printing to the printing inexecution area 402, the unique portion mark 401 and the printing inexecution area 403, but with applying the printing the preliminary discharge pattern 404 and the cut mark 405 to the following area, and the operation is returned to the normal printing.

Subsequently, a description will be given of the case where the unique portion mark is continuously detected with reference to FIG. 6.

FIG. 6 shows a print pattern of a continuous sheet 600 in the case where the unique portion mark is continuously detected. In the case where the unique portion mark 608 is detected, an adjustment blank 605 is inserted as occasion demands, and a cut mark 606 is printed in the same manner as the case of the print pattern in FIG. 5. Thereafter, in the case where the continuous sheet is fed, and the next unique portion mark 610 is detected, during which the printing head 14 scans a printing inexecution area 609 which follows to the unique portion mark 608, it is determined that the printing inexecution area is continuous. In the same manner, in the case where the continuous sheet is fed, and the next unique portion marks 612 and 614 are continuously detected, during which the printing head 14 scans the printing inexecution area, it is determined that the printing inexecution area is further continuous.

Here, a description will be given of the cut of the continuous sheet. In the case where a length of the continuous printing inexecution area reaches a predetermined length L (617) by measuring from a head of the printing inexecution area 607, the continuous sheet is cut at the length. In this case, a position to be cut is an interruption cut position 1 (618) which exists within a printing inexecution area 615, thus the cut mark can not be printed. Accordingly, in order to cut the continuous sheet without depending on the cut mark, a cutting command is directly given to the cutter unit 6. Further, in order to remove the remaining portion of the printing inexecution area 615, a command is given to the cutter unit 6 so as to cut at an interruption cut position 2 (619).

Here, a description will be given of an example of a method of determining the predetermined length L (617).

First of all, as the example of the method of determining the predetermined length L, the predetermined length L can be simply set to a constant length which can be loaded to the tray of the discharging unit 12 in the printer apparatus.

Further, as the other example of the method of determining the predetermined length L, there is a method that a user individually sets the predetermined length L on the basis of an external factor. The user may process the printed image by using the other apparatus, for example, a cutting machine, after the printing is finished. The specification of the cutting machine is defined for each apparatus, and there exists a cutting machine which can not handle a sheet having a length beyond a predetermined length. In this case, the user can previously input a constant length (fixed length) which is equal to or shorter than a predetermined length which is unique to the apparatus, as the predetermined length L, by using the operation unit 15.

Further, as the other example of the method of determining the predetermined length L, there is a method of setting the predetermined length L on the basis of formula which is obtained from a relationship between a feeding speed and a time during which printing is not executed. For example, the predetermined length L can be calculated from a feeding speed V and a non-dischargeable time T, according to formula 701 in FIG. 7. The feeding speed V is a speed for feeding the continuous sheet, and is determined according to a print mode. The non-dischargeable time T is a time which is determined from a viewpoint of a characteristic of the printing head 14, and is set to a time which does not affect image quality without discharging or a time within the time. The predetermined length L calculated as mentioned above is employed preferably in the case where the predetermined length L is the length which can be loaded to the tray of the discharging unit 12, or the length which is equal to or shorter than the predetermined length which is unique to the apparatus, for example, the cutting machine.

In the case where the continuous sheet is subjected to an interruption-cut at the predetermined length L, the sheet feeding is continued without discharging the ink to the remaining printing inexecution area (a part of the area 615 in FIG. 6). The continuous sheet is next cut at the interruption cut position 2 (619). As a result, a sheet piece including the remaining printing inexecution area is cut from the continuous sheet and is discharged from the printing apparatus. Further, the continuous sheet is rewound by the printing apparatus, and is again supplied. The printing of the following unit image is restarted after an appropriate maintenance for keeping the printing head is carried out. In other words, first of all, the preliminary discharge pattern 301 is printed to the head of the printing as shown in FIG. 3, and the ink jet head is recovered. Thereafter, the printing of the cut mark and the unit image is repeated.

As mentioned above, according to the present structure, it is possible to control the printing without cutting the continuous sheet as much as possible. As a result, it is possible to prevent a printing efficiency from being lowered due to the rewinding and the re-feeding of the continuous sheet or the like. Further, it is possible to discharge the sheet piece having the length which can be accommodated in the discharging unit of the printing apparatus. Further, it is possible to discharge the sheet piece having the length which is easily processed by the post process. Further, even in the case where the printing inexecution area is continuous, it is possible to achieve a sufficient recovery of the nozzles.

Figure 8:
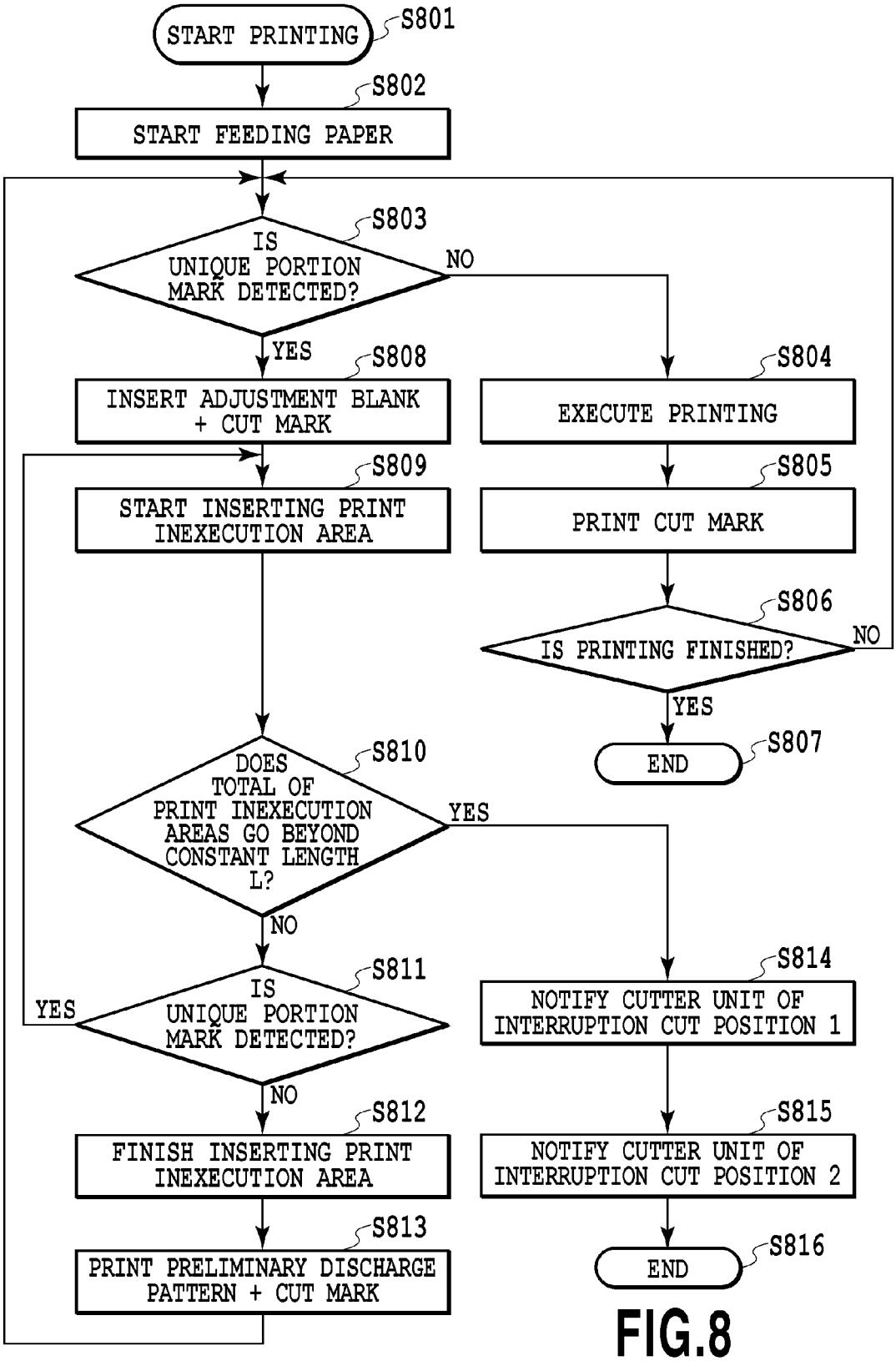
FIG. 8 is a flow chart for describing a printing operation according to an embodiment.

A description will be given of a flow of a printing operation according to the present invention with reference to FIG. 8.

In the case where a printing command is given from the host device 16 in step S801, the printing is started. Subsequently, the feed of the continuous sheet is started by using the sheet supply unit 1 in step S802. Subsequently, in step S803, it is determined whether or not the unique portion mark is detected.

In the case where it is determined that the unique portion mark is not detected in step S803, the process goes to step S804. A desired unit image is printed in step S804, and the cut mark is next printed in step S805. Subsequently, in step S806, it is determined whether or not the unit images which are instructed to be printed are all printed. In the case where the unit images are not all printed, the process goes to step S803, and the processes up to step S806 are repeated until the unique portion mark is determined to be detected. In the case where all the unit images are printed, the process goes to step S807, and the present flow is finished. The flow in steps S803, S804, S805 and S806 expresses the repeat of the normal printing which is described in FIG. 3.

In step S803, it is determined that the unique portion mark is detected, the process goes to step S808. In step S808, the adjustment blank is inserted and the cut mark is printed. Subsequently, in step S809, an insertion of the printing inexecution area is started. This means that the continuous sheet is fed until the insertion of the printing inexecution area is finished in step S812. During the feed of the continuous sheet, step S810 and a step S811 are carried out. In step S810, it is determined whether or not the length of the printing inexecution area exceeds the predetermined length L.

In step S810, it is determined that the length of the printing inexecution area does not exceed the predetermined length L, the process goes to step S811. In step S811, it is determined whether or not the unique portion mark is again detected. In the case where the detection is determined, the process goes to the step S809, and the processes up to the step S811 are repeated. In the case where the non-detection is determined, the process goes to step S812, and the insertion of the printing inexecution area is finished. Subsequently, the preliminary discharge pattern and the cut mark are printed in step S813, and the process goes to step S803. A flow shown by steps S803, S808, S809, S810, S811, S812 and S813 expresses the process until the return to the normal printing after the unique portion mark is detected, which is described in FIGS. 5 and 6. Steps S809 to S811 are carried out only one time in the case where the unique portion mark is sporadically detected as shown in FIG. 5, and the processes from step S809 to step S811 are repeated in the case where a plurality of unique portion marks are detected, which is shown in FIG. 6.

In the case where it is determined that the length of the printing inexecution area exceeds the predetermined length L in step S810, the process goes to step S814. In step S814, the interruption cut position 1 is notified to the cutter unit 6, and in step S815, the interruption cut position 2 is next notified to the cutter unit 6. Subsequently, the process goes to step S816, and the present flow is finished. The flow shown by steps S810, S814, S815 and S816 expresses the process in the case where the length of the continuous printing inexecution area reaches the predetermined length L measuring from the head of the printing inexecution area, which is described in FIG. 6.

A description will be given of a flow until the continuous sheet is discharged to the tray of the discharging unit 12 after being cut by the cutter unit 6, with reference to FIG. 9.

Figure 9:
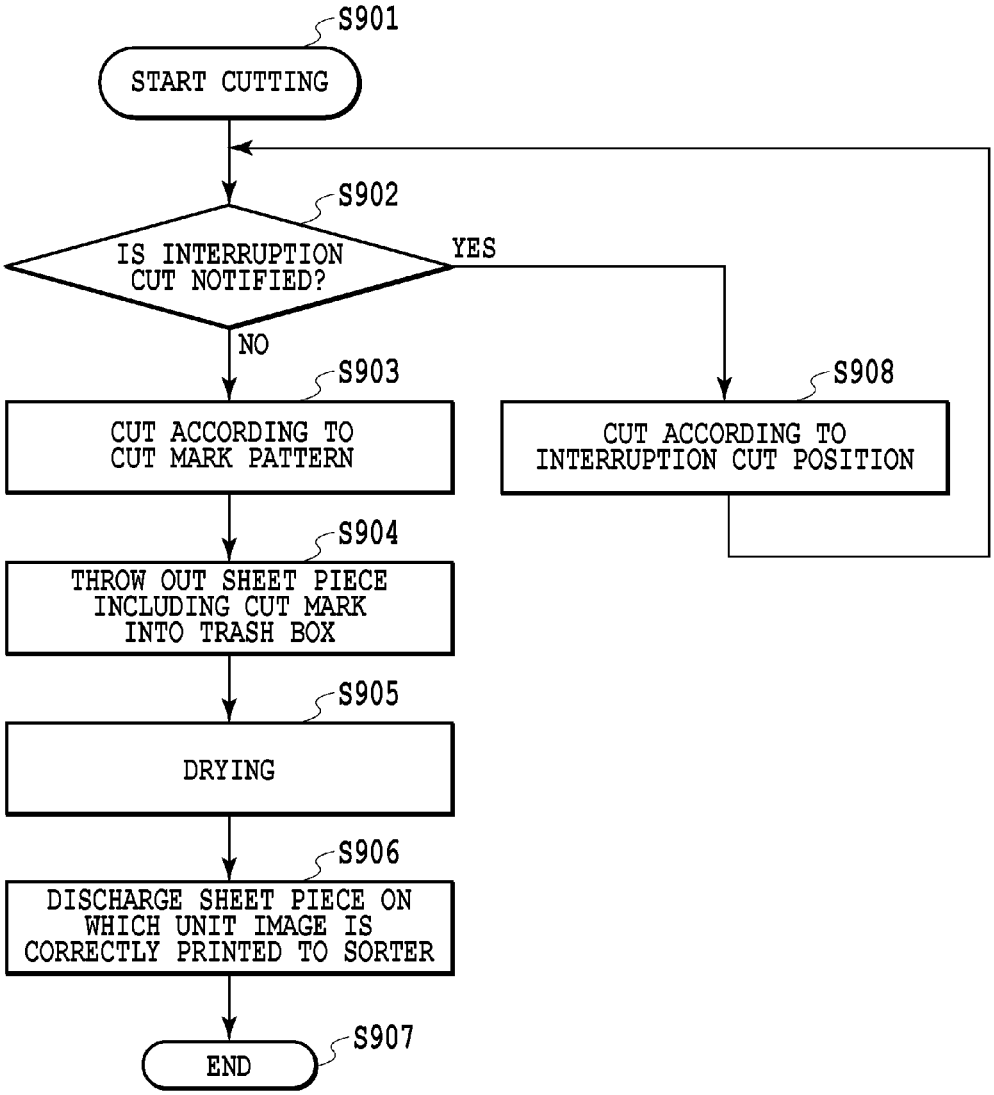
FIG. 9 is a flow chart for describing a cutting operation according to the embodiment.

The cut is started in step S901 in FIG. 9 and the process goes to step S902. In step S902, it is determined whether or not the interruption cut position is notified from the printing unit 4. Specifically, it is determined whether or not the notice described in steps S814 and S815 is given.

In the case where it is determined that the notice of the interruption cut position is given in step S902, the cut is carried out according to the notice even in the case where the cut mark does not exist. In other words, the process goes to a step S908, and the cut is carried out according to the interruption cut position. In this case, a plurality of sheet pieces which are cut and segmentalized are discharged to the discharging unit 12 through the third path. Subsequently, the process returns to step S902.

In the case where it is determined that the notice of the interruption cut position is not given in step S902, the process goes to step S903, and the cut is carried out on the basis of the cut mark. Subsequently, in step S904, the sheet piece including the cut mark is thrown out into the trash box 19. The other sheet pieces are continuously fed. Subsequently, in step S905, the sheet pieces fed to the drying unit 8 are dried by using the drying unit 8. Subsequently, in step S906, the sheet pieces in which the unit images are correctly printed are discharged to the discharging unit 12, among the dried sheet pieces. Subsequently, the process goes to step S907, and the present flow is finished.

In the present embodiment, in the case where the unique portion marks are continuously detected and the printing inexecution area becomes longer, the continuous sheet is cut at a time point reaching the predetermined length L. As a result, the printing can be continued without cutting the continuous sheet as much as possible, and it is possible to inhibit the printing efficiency from being lowered due to the rewinding and the re-feeding of the continuous sheet. Further, it is possible to discharge the sheet piece having the length which fits within the discharging unit of the printing apparatus. Further, it is possible to discharge the sheet piece having the length which can be easily worked in the post process. Further, it is possible to dissolve an undesirable influence (clogging) applied to the printing head due to inexecution of discharge for a long time, by applying an appropriate maintenance of the printing head to the sheet area after the printing inexecution area is finished.

In the present embodiment described above, the area in which the unique portion is generated is specified by detecting the unique portion mark which is directly applied to the area in which the unique portion is generated. However, the present invention is not limited to this, but may be structured such that information for specifying the area in which the unique portion is generated is previously prepared as data configuration, and the area is specified on the basis of the data configuration. For example, the data may be stored as a magnetic data style in a compact disc (CD) or the other magnetic medium, or may be labeled or printed as a bar code mode or a two-dimensional code (QR code (Trade Mark)) style on a package of the continuous sheet or the continuous sheet itself.

In the embodiment mentioned above, the description refers to the case where the unique portion is generated in the manufacturing process of the sheet, and the description is given of the example that the area in which the unique portion is generated is previously apparent. However, in the present invention, the printer apparatus may directly detect the unique portion by a sensor. In other words, the unique portion may be generated, for example, in the case where the wind-up roll of the continuous sheet is conveyed, is stored or is rewound, in addition to the manufacturing process of the sheet. Further, the unique portion can be generated in the case of being exposed to environment of light, high temperature or high moisture or by a chemical deterioration with age, in addition to a physical cause. According to the direct detecting mode, the effect of the present invention can be obtained in the case where the unique portion is generated after the manufacturing process, as well as the case where the unique portion is generated in the manufacturing process of the sheet in the same manner. In other words, in the case where the unique portions continuously appear, it is possible to continue the printing without cutting the continuous sheet as much as possible, and it is possible to inhibit the printing efficiency from being lowered by the rewinding or the re-feeding of the continuous sheet. Further, it is possible to discharge the sheet piece having the length which fits within the discharging unit of the printing apparatus. Further, it is possible to discharge the sheet piece having the length which can be easily worked in the post process. Further, it is possible to dissolve the undesirable influence applied to the printing head due to the inexecution of discharge for a long time, by applying the appropriate maintenance of the printing head to the sheet area after the printing inexecution area is finished.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-169456, filed Jul. 31, 2012, which is hereby incorporated by reference herein in its entirety.

What is claimed is:

1. A printing apparatus, comprising:

a specifying unit configured to specify an unsuitable area of a continuous sheet which is not suitable for an image printing;

a print control unit configured to cause an ink jet type printing unit to print images on a continuous sheet; and a cutter control unit configured to cause a cutter unit to cut the continuous sheet on which the images are printed by the printing unit, per a predetermined unit length, wherein the cutter control unit controls so as to cause the cutter unit to cut, in a case where a printing inexecution area on which printing is not executed due to an existence of the unsuitable area exceeds a predetermined length determined on the basis of a non-dischargeable time of the printing unit, a printing inexecution area of the continuous sheet into a plurality of sheet pieces.

2. The printing apparatus according to claim 1, further comprising a detecting unit which detects the unsuitable area, wherein the control unit sets the printing inexecution area on the basis of detection by the detecting unit.

3. The printing apparatus according to claim 1, further comprising a setting unit which sets the printing inexecution area which includes the unsuitable area.

4. The printing apparatus according to claim 3, wherein the setting unit sets an area around the unique portion mark as the printing inexecution area.

5. The printing apparatus according to claim 1, wherein the unsuitable area is an area where an unique portion mark exists.

6. The printing apparatus according to claim 1, wherein the print control unit restarts printing images after a maintenance of the printing unit has been carried out in a case where the cutter control unit controls so as to cause the cutter unit to cut the printing inexecution area into a plurality of sheet pieces.

7. The printing apparatus according to claim 1, further comprising the printing unit.

8. The printing apparatus according to claim 1, further comprising the cutter unit.

9. The printing apparatus according to claim 1, further comprising the printing unit.

10. A control method for printing images on a continuous sheet, the method comprising:

specifying an unsuitable area on the continuous sheet which is not suitable for image printing;

printing images on the continuous sheet with an ink jet type printing unit;

cutting a continuous sheet, on which the images have been printed, per a predetermined unit length; and causing a cutter unit to cut, in a case where a length of a printing inexecution area on which printing is not executed due to an existence of the unsuitable area exceeds a predetermined length that is determined on the basis of a non-dischargeable time of the printing unit, the printing inexecution area of the continuous sheet into a plurality of sheet pieces.

11. The method according to claim 10, further comprising the step of calculating the predetermined length on the basis of a feeding speed of the continuous sheet and a time that the printing is not executed.

12. The method according to claim 10, wherein said predetermined length is a value which is set by a user.

13. The method for according to claim 10, wherein said area is set on the basis of previously prepared information which indicates a position of said unique portion.

14. The method according to claim 10, further comprising setting the printing inexecution area which includes the unsuitable area.

15. The method according to claim 14, wherein the printing inexecution area is set on the basis of detection of the unsuitable area.

16. The method according to claim 14, wherein an area around the unique portion mark is set as the printing inexecution area.

17. The method according to claim 10, wherein the unsuitable area is an area where an unique portion mark exists.

18. The method according to claim 10, wherein printing images is restarted after a maintenance of the printing unit has been carried out in a case where the cutter unit is caused to cut the printing inexecution area into a plurality of sheet pieces.

* * * * *